US009540595B2

(12) United States Patent
Hulskotter et al.

(10) Patent No.: US 9,540,595 B2
(45) **Date of Patent: *Jan. 10, 2017**

(54) COMPOSITIONS COMPRISING ALKOXYLATED POLYALKYLENEIMINES HAVING LOW MELTING POINTS

(71) Applicant: The Procter & Gamble Company, Cincinnati, OH (US)

(72) Inventors: Frank Hulskotter, Bad Duerkheim (DE); Brian Joseph Loughnane, Fairfield, OH (US); Sophia Rosa Ebert, Mannheim (DE); Bjoern Ludolph, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/328,734

(22) Filed: Jul. 11, 2014

(65) Prior Publication Data

US 2015/0057213 A1 Feb. 26, 2015

Related U.S. Application Data

(60) Provisional application No. 61/869,843, filed on Aug. 26, 2013.

(51) Int. Cl.

| | |
|---|---|
| ***C11D 1/00*** | (2006.01) |
| ***C11D 3/30*** | (2006.01) |
| ***C11D 3/386*** | (2006.01) |
| ***C11D 3/37*** | (2006.01) |
| *C11D 1/02* | (2006.01) |
| *C11D 1/38* | (2006.01) |
| *C11D 1/88* | (2006.01) |
| *C11D 1/66* | (2006.01) |
| *C11D 3/40* | (2006.01) |
| *C11D 11/00* | (2006.01) |

(52) U.S. Cl.

CPC . *C11D 3/30* (2013.01); *C11D 1/00* (2013.01); *C11D 3/3723* (2013.01); *C11D 3/38618* (2013.01); *C11D 3/38627* (2013.01); *C11D 3/38636* (2013.01); *C11D 1/02* (2013.01); *C11D 1/38* (2013.01); *C11D 1/66* (2013.01); *C11D 1/88* (2013.01); *C11D 3/40* (2013.01); *C11D 11/0017* (2013.01)

(58) Field of Classification Search

CPC ..... C11D 1/00; C11D 1/02; C11D 1/38; C11D 1/66; C11D 1/88; C11D 3/30; C11D 3/40; C11D 3/386; C11D 3/38609; C11D 3/38618; C11D 3/38627; C11D 11/0017

USPC ..... 510/320, 321, 392, 393, 499; 8/137

See application file for complete search history.

(56) References Cited

U.S. PATENT DOCUMENTS

| | | | |
|---|---|---|---|
| 3,301,782 | A | 1/1967 | Dickson |
| 3,489,686 | A | 1/1970 | Parran, Jr. |
| 3,549,542 | A | 12/1970 | Holderby |
| 3,549,546 | A | 12/1970 | Moore |
| 3,580,853 | A | 5/1971 | Parran, Jr. |
| 3,642,572 | A | 2/1972 | Endres et al. |
| 3,838,057 | A | 9/1974 | Morrison Barnes et al. |
| 4,144,123 | A | 3/1979 | Scharf et al. |
| 4,171,278 | A | 10/1979 | Andree et al. |
| 4,267,088 | A | 5/1981 | Kempf |
| 2,039,938 | A | 2/1983 | Vanlerbergh et al. |
| 4,371,674 | A | 2/1983 | Hertel et al. |
| 4,372,882 | A | 2/1983 | Koster |
| 4,386,000 | A | 5/1983 | Turner et al. |
| 4,389,219 | A | 6/1983 | Naka et al. |
| 4,415,705 | A | 11/1983 | Hutter |
| 4,548,744 | A | 10/1985 | Connor |
| 4,551,506 | A | 11/1985 | Gosselink |
| 4,561,991 | A | 12/1985 | Herbots et al. |
| 4,597,898 | A | 7/1986 | Vander Meer |
| 4,614,762 | A | 9/1986 | Marans et al. |
| 4,622,378 | A | 11/1986 | Gosselink |
| 4,634,544 | A | 1/1987 | Weber |
| 4,645,611 | A | 2/1987 | Campbell et al. |
| 4,654,403 | A | 3/1987 | Streit et al. |
| 4,659,382 | A | 4/1987 | Kang |
| 4,659,802 | A | 4/1987 | Rubingh et al. |
| 4,661,288 | A | 4/1987 | Rubingh et al. |
| 4,664,848 | A | 5/1987 | Oh et al. |
| 4,672,320 | A | 6/1987 | Sekihara |
| 4,676,921 | A | 6/1987 | Vander Meer |

(Continued)

FOREIGN PATENT DOCUMENTS

| | | |
|---|---|---|
| EP | 112592 A2 | 4/1984 |
| EP | 0206513 | 12/1986 |

(Continued)

OTHER PUBLICATIONS

PCT International Search Report for application No. PCT/US2014/046263, dated Nov. 3, 2014, containing 10 pages.

*Primary Examiner* — Gregory R Delcotto

(74) *Attorney, Agent, or Firm* — Gregory S. Darley-Emerson; Leonard W Lewis; Steven W Miller

(57) ABSTRACT

The present invention relates to compositions comprising water-soluble alkoxylated polyalkyleneimines with a low melting point. More specifically, the present invention relates to compositions comprising water-soluble alkoxylated polyalkyleneimines having an inner polyethylene oxide block comprising 5 to 18 polyethylene oxide units, a middle polyalkylene oxide block comprising 1 to 5 polyalkylene oxide units and an outer polyethylene oxide block comprising 2 to 14 polyethylene oxide units.

20 Claims, No Drawings

(56) References Cited

U.S. PATENT DOCUMENTS

| | | | |
|---|---|---|---|
| 4,689,167 | A | 8/1987 | Collins et al. |
| 4,789,400 | A | 12/1988 | Solodar et al. |
| 4,891,160 | A | 1/1990 | Vander Meer |
| 4,967,008 | A | 10/1990 | Friedli et al. |
| 5,129,948 | A | 7/1992 | Breton et al. |
| 5,183,601 | A | 2/1993 | Jisai et al. |
| 5,223,028 | A | 6/1993 | Aulick et al. |
| 5,451,341 | A | 9/1995 | White |
| 5,565,145 | A | 10/1996 | Watson et al. |
| 5,858,348 | A | 1/1999 | Matsuda et al. |
| 5,914,443 | A | 6/1999 | Kalum |
| 5,968,893 | A | 10/1999 | Manoher et al. |
| 1,111,708 | A | 11/1999 | Furutani et al. |
| 6,004,922 | A | 12/1999 | Watson et al. |
| 6,008,181 | A | 12/1999 | Cripe et al. |
| 6,015,781 | A | 1/2000 | Vinson et al. |
| 6,020,303 | A | 2/2000 | Cripe et al. |
| 6,046,152 | A | 4/2000 | Vinson et al. |
| 6,057,278 | A | 5/2000 | Gosselink et al. |
| 6,060,443 | A | 5/2000 | Cripe et al. |
| 6,066,612 | A | 5/2000 | Murata et al. |
| 6,071,871 | A | 6/2000 | Gosselink et al. |
| 6,075,000 | A | 6/2000 | Rohrbaugh et al. |
| 6,087,316 | A | 7/2000 | Watson et al. |
| 6,093,856 | A | 7/2000 | Cripe et al. |
| 6,121,226 | A | 9/2000 | Gosselink et al. |
| 6,133,222 | A | 10/2000 | Vinson et al. |
| 6,153,577 | A | 11/2000 | Cripe et al. |
| 6,191,093 | B1 | 2/2001 | Watson et al. |
| 6,228,829 | B1 | 5/2001 | Vinson et al. |
| 6,232,282 | B1 | 5/2001 | Kvietok et al. |
| 6,242,406 | B1 | 6/2001 | Katsuda et al. |
| 6,274,540 | B1 | 8/2001 | Scheibel et al. |
| 6,281,181 | B1 | 8/2001 | Vinson et al. |
| 6,291,415 | B1 | 9/2001 | Watson et al. |
| 6,306,817 | B1 | 10/2001 | Kott et al. |
| 6,326,348 | B1 | 12/2001 | Vinson et al. |
| 6,369,024 | B1 | 4/2002 | Panandiker et al. |
| 6,380,143 | B1 | 4/2002 | Kvietok et al. |
| 6,444,633 | B2 | 9/2002 | Price |
| 6,448,213 | B1 | 9/2002 | Willman |
| 6,472,359 | B1 | 10/2002 | Ghosh |
| 6,479,451 | B2 | 11/2002 | Price |
| 6,482,789 | B1 | 11/2002 | Kvietok et al. |
| 6,498,134 | B1 | 12/2002 | Scheibel et al. |
| 6,506,717 | B1 | 1/2003 | Kott et al. |
| 6,514,926 | B1 | 2/2003 | Kott et al. |
| 6,525,012 | B2 | 2/2003 | Price |
| 6,566,319 | B1 | 5/2003 | Scheibel et al. |
| 6,579,839 | B2 | 6/2003 | Price |
| 6,583,096 | B1 | 6/2003 | Kott et al. |
| 6,596,680 | B2 | 7/2003 | Kott et al. |
| 6,696,402 | B2 | 2/2004 | Gosselink et al. |
| 6,812,198 | B2 | 11/2004 | Dupont et al. |
| 6,903,059 | B2 | 6/2005 | Price |
| 6,914,041 | B2 | 7/2005 | Price |
| 7,163,985 | B2 | 1/2007 | Ortiz et al. |
| 8,097,579 | B2 | 1/2012 | Danziger et al. |
| 2009/0088363 | A1* | 4/2009 | Panandiker ..... C11D 3/40 510/343 |
| 2011/0034365 | A1* | 2/2011 | Lant ..... C11D 3/226 510/298 |
| 2011/0065624 | A1* | 3/2011 | Boutique ..... C11D 3/2093 510/296 |
| 2012/0094886 | A1* | 4/2012 | Mellies ..... C11D 1/62 510/163 |
| 2015/0057211 | A1 | 2/2015 | Hulskotter et al. |

FOREIGN PATENT DOCUMENTS

| | | |
|---|---|---|
| EP | 0269169 B1 | 8/1992 |
| WO | WO 97/23546 | 7/1997 |
| WO | WO 97/42283 | 11/1997 |
| WO | WO 97/42284 | 11/1997 |
| WO | WO 97/42286 | 11/1997 |
| WO | WO 97/42287 | 11/1997 |
| WO | WO 98/15607 | 4/1998 |
| WO | WO 98/15608 A2 | 4/1998 |
| WO | WO 98/20098 | 5/1998 |
| WO | WO 98/50513 A1 | 11/1998 |
| WO | WO 99/02663 A1 | 1/1999 |
| WO | WO 99/19429 A1 | 4/1999 |
| WO | WO 99/19444 | 4/1999 |
| WO | WO 00/23548 | 4/2000 |
| WO | WO 00/42146 A1 | 7/2000 |
| WO | WO 00/43473 | 7/2000 |
| WO | WO 0043478 | 7/2000 |
| WO | WO 01/05923 A1 | 1/2001 |

* cited by examiner

COMPOSITIONS COMPRISING ALKOXYLATED POLYALKYLENEIMINES HAVING LOW MELTING POINTS

FIELD OF THE INVENTION

The present invention relates to compositions comprising alkoxylated polyalkyleneimines with a low melting point. More specifically, the present invention relates to compositions comprising alkoxylated polyalkyleneimines having an inner polyethylene oxide block comprising 5 to 18 polyethylene oxide units, a middle polyalkylene oxide block comprising 1 to 5 polyalkylene oxide units and an outer polyethylene oxide block comprising 2 to 14 polyethylene oxide units.

BACKGROUND OF THE INVENTION

Alkoxylated polyalkyleneimines are known. For example, polyalkyleneimines having a backbone molecular weight of from 600 to 25000 g/mol are known, wherein the polyamine backbone is first modified by 1 to 10 propyleneoxy units, butyleneoxy units and mixtures thereof, followed by ethyleneoxy units such that the total degree of alkyleneoxylation does not exceed 50 units.

Amphiphilic water-soluble alkoxylated polyalkyleneimines are known, wherein the polyamine backbone is first modified by an inner polyalkylene oxide block of propylene oxide, butylene oxide and/or isobutylene oxide, a second middle polyethylene oxide block and an outer polypropylene oxide block.

Amphiphilic water-soluble alkoxylated polyalkyleneimines having an inner polyethylene oxide block comprising 20 to 50 polyethylene oxide units and an outer polypropylene oxide block comprising 10 to 50 polypropylene oxide units are also known.

Polyethyleneimines which have initially been ethoxylated and then propoxylated are known as breakers for crude oil emulsions.

Ethoxylated and/or propoxylated polyalkyleneamine polymers, which have an average ethoxylation/propoxylation of from 0.5 to 10 per nitrogen, that boost soil dispersing performance are known.

Cleaning compositions comprising alkoxylated polyalkylenimines are also known. The alkoxylated polyalkylenimines help to provide cleaning benefits, such as soil antiredeposition benefits.

When the polyamine backbones of ethoxylated polyalkylenimines are modified with polyethylene oxide units, particularly when the polyamine backbones are modified with a total of fourteen or more polyethylene oxide units per nitrogen atom, the polyalkylenimines are typically solid at room temperature and, thus, generally require melting or incorporation into aqueous solution before further processing. Ethoxylated polyalkyleneimines that are liquid at room temperature would therefore be easier to process and handle.

There is a need, therefore, to provide ethoxylated polyalkylenimines that are liquid at or below room temperature, e.g., at or below 25° C., and cleaning compositions containing the same.

SUMMARY OF THE INVENTION

The present disclosure relates to a cleaning composition comprising from about 1% to about 70% by weight of a surfactant system; and a water-soluble alkoxylated polyalkylenimine of the general formula I

I

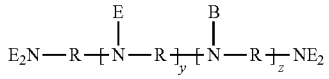

in which the variables are each defined as follows:

R represents identical or different, linear or branched $C_2$-$C_{12}$-alkylene radicals or an etheralkyl unit of formula X:

X

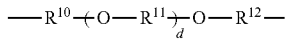

in which the variables are each defined as follows:

$R^{10}$, $R^{11}$, $R^{12}$ represent identical or different, linear or branched $C_2$-$C_6$-alkylene radicals and d is an integer having a value in the range of from about 0 to about 50;

B represents a continuation of the alkoxylated polyalkylenimine by branching;

y is from about 0 to about 150, z is greater than 0 and less than or equal to about 150;

E is an alkylenoxy unit of the formula II

II

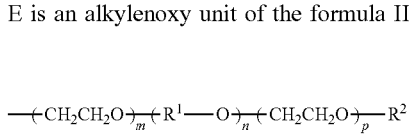

in which the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

The present disclosure also relates to a cleaning composition comprising from about 1% to about 70% by weight of a surfactant system; and from about 0.1% to about 5% by weight of a water-soluble alkoxylated polyalkylenimine of the general formula IV,

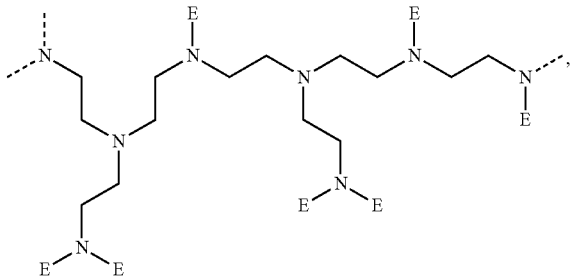

wherein E is an alkylenoxy unit of the formula II

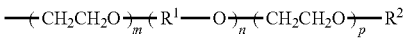

II in which the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

The present disclosure also relates to a method of pretreating or treating a soiled fabric comprising contacting the soiled fabric with the described cleaning compositions.

DETAILED DESCRIPTION OF THE INVENTION

Features and benefits of the various aspects of the present invention will become apparent from the following description, which includes examples of specific embodiments intended to give a broad representation of the invention.

As used herein, the articles including "the," "a" and "an" when used in a claim or in the specification, are understood to mean one or more of what is claimed or described.

As used herein, the terms "include," "includes" and "including" are meant to be non-limiting.

As used herein, the terms "substantially free of" or "substantially free from" mean that the indicated material is at the very minimum not deliberately added to the composition to form part of it, or, preferably, is not present at analytically detectable levels. It is meant to include compositions whereby the indicated material is present only as an impurity in one of the other materials deliberately included.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

In this description, all concentrations and ratios are on a weight basis of the cleaning composition unless otherwise specified.

Cleaning Composition

As used herein the phrase "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multi-phase unit dose, pouch, tablet, gel, paste, bar, or flake.

Ethoxylated Polyalkylenimine

Cleaning compositions of the present disclosure comprise an alkoxylated polyalkylenimine, in some aspects, an ethoxylated polyalkylenimine. In some aspects, the polyamine backbone is modified by about one to about fourteen polyethylene oxide units per nitrogen atom. In some aspects, the polyamine backbone is modified by about fourteen or more polyethylene oxide units per nitrogen atom.

It has been found that the shortcomings of the previously described ethoxylated polyalkyleneimines, e.g., having a melting point above room temperature, may be overcome by adding a middle block of propylene oxide, butylene oxide and/or pentene oxide to the polyethylene oxide block that is condensed with the polyamine backbone of the polyalkylenimine. The resulting ethoxylated polyaklyenimine may be formulated into a cleaning composition.

Cleaning compositions of the present disclosure may comprise a water-soluble alkoxylated polyalkylenimine of the general formula I

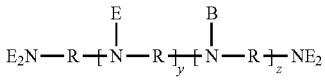

I in which the variables are each defined as follows:

R represents identical or different, linear or branched $C_2$-$C_{12}$-alkylene radicals or an etheralkyl unit of formula X:

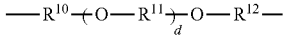

X in which the variables are each defined as follows:

$R^{10}$, $R^{11}$, $R^{12}$ represent identical or different, linear or branched $C_2$-$C_6$-alkylene radicals and d is an integer having a value in the range of from about 0 to about 50;

B represents a continuation of the alkoxylated polyalkylenimine by branching;

y is from about 0 to about 150, z is greater than 0 and less than or equal to about 150;

E is an alkylenoxy unit of the formula II

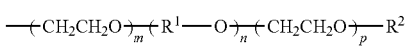

II in which the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

In some examples, the sum of y+z is from about 1 to about 100, typically from about 1 to about 50, more typically from about 1 to about 20 or from about 1 to about 10.

In the above structure (I), the alkoxylated polyalkylenimine has an alkylenoxy unit (E) of the formula II, which comprises a middle polyalkylene oxide block, defined by $(R^1—O)_n$; it is considered "middle" because it is between two polyethylene oxide blocks, defined by $(CH_2CH_2O)_p$ and $(CH_2CH_2O)_m$. One of the polyethylene oxide blocks may be an outer polyethylene oxide block, defined by $(CH_2CH_2O)_p$. One of the polyethylene oxide blocks may be an inner polyethylene oxide block, defined by $(CH_2CH_2O)_m$.

The inventive alkoxylated polyalkylenimines have a basic skeleton, e.g. a polyamine backbone, which comprises primary, secondary, and tertiary amino groups that are joined by alkylene radicals, R, and are in the form of the following moieties in random arrangement:

primary amino moieties that terminate the main chain and the side chains of the basic skeleton, the hydrogen atoms of which are subsequently replaced by alkylenoxy units:

$[H_2N—R—]$ and $—NH_2$ secondary amino moieties, the hydrogen atom of which is subsequently replaced by alkylenoxy units:

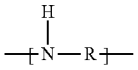

and tertiary amino moieties which branch the main chain and the side chains:

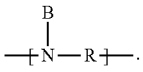

In some aspects, before the alkoxylation, the polyalkylenimine has a weight average molecular weight ($M_w$) of from about 50 g/mol to about 10 000 g/mol, typically from about 250 to about 10 000 g/mol. In some aspects, the weight average molecular weight $M_w$ of the polyalkylenimine before the alkoxylation is from about 250 to about 5000 g/mol, or from about 400 to about 3000 g/mol, or from about 600 to about 1800 g/mol. The sum x+y+z of the repeating units of the primary, secondary and tertiary amino moieties means a total number of alkylenimine units which corresponds to these molecular weights.

In some aspects, the R radicals connecting the nitrogen atoms of the amino groups may be identical or different, linear or branched $C_2$-$C_{12}$-alkylene radicals, typically $C_2$-$C_6$-alkylene radicals. In some aspects, one or more of the R radicals is a branched $C_2$-$C_6$-alkylene radical. In certain aspects, one or more of the R radicals is 1,2-propylene. In some aspects, one or more of the R radicals is ethylene or hexamethylene.

The hydrogen atoms of the primary and secondary amino groups of the basic polyalkylenimine skeleton may be replaced by alkylenoxy units of the formula II $$—(CH_2CH_2O)_m—(R^1—O)_n—(CH_2CH_2O)_p—R^2. \quad \text{II}$$

In formula II, the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

In some aspects, $R^2$ represents hydrogen and/or $C_1$-$C_4$-alkyl.

In some aspects, the modified polyalkyleneimine has the general structure of formula (III):

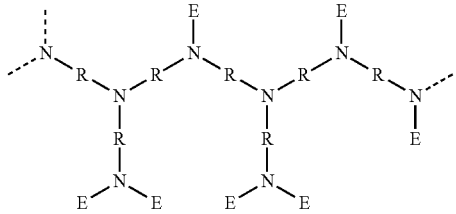

III wherein the R groups are identical or different, linear or branched $C_2$-$C_{12}$-alkylene radicals, and wherein E is an alkylenoxy unit of the formula II $$—(CH_2CH_2O)_m—(R^1—O)_n—(CH_2CH_2O)_p—R^2 \quad \text{II}$$

in which the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

In some aspects, the modified polyalkyleneimine has the general structure of formula (IV), Formula IV

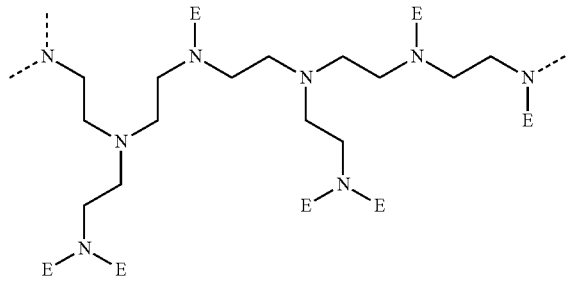

wherein E is an alkylenoxy unit of the formula II $$-(CH_2CH_2O)_m(R^1-O)_n(CH_2CH_2O)_p-R^2 \quad \text{II}$$

in which the variables are each defined as follows:

$R^1$ represents 1,2-propylene, 1,2-butylene and/or 1,2-pentene;

$R^2$ represents hydrogen and/or $C_1$-$C_{22}$-alkyl and/or $C_7$-$C_{22}$ aralkyl;

m is an integer having a value in the range of from about 5 to about 18;

n is an integer having a value in the range of from about 1 to about 5;

p is an integer having a value in the range of from about 2 to about 14.

In any of the above-described alkylenoxy units of Formula II, each of m and p may independently have a value in the range of from about 2 to about 18, or 5 to about 14. In some aspects, m+p is equal to or greater than about 14, or equal to or greater than about 16, or equal to or greater than about 20. In some aspects, m+p is from about 7 to about 50, or from about 14 to about 35, or from about 16 to about 30, or from about 20 to about 25, or about 21. In some aspects, n is from about 1 to about 5, or from about 2 to about 4.

In some aspects, the alkoxylated polyalkylenamines are liquid at or below room temperature, e.g., at or below 25° C. In some aspects, the alkoxylated polyalkylenamines have a melting point at or below about 25° C., or at or below about 20° C., or at or below about 15° C., or at or below about 10° C.

The alkoxylated polyalkylenimines may also be quaternized. A suitable degree of quaternization is up to about 100%, or from about 10 to about 95%. The alkoxylated polyalkylenimines may be quaternized by introducing $C_1$-$C_{22}$-alkyl groups, $C_1$-$C_4$-alkyl groups and/or $C_7$-$C_{22}$ aralkyl groups and may be performed in a customary manner by reaction with corresponding alkyl halides and dialkyl sulfates.

The quaternization of alkoxylated polyalkylenimines may be achieved by introducing $C_1$-$C_{22}$ alkyl, $C_1$-$C_4$-alkyl groups and/or $C_7$-$C_{22}$ aralkyl, aryl or alkylaryl groups and may be undertaken in a customary manner by reaction with corresponding alkyl-, aralkyl—halides and dialkylsulfates, as described for example in WO 09/060059.

Quaternization may be accomplished, for example, by reacting an alkoxylated polyalkylenimine with an alkylation agent such as a $C_1$-$C_4$-alkyl halide, for example with methyl bromide, methyl chloride, ethyl chloride, methyl iodide, n-butyl bromide, isopropyl bromide, or with an aralkyl halide, for example with benzyl chloride, benzyl bromide or with a di-$C_1$-$C_{22}$-alkyl sulfate in the presence of a base, especially with dimethyl sulfate or with diethyl sulfate. Suitable bases are, for example, sodium hydroxide and potassium hydroxide.

The amount of alkylating agent determines the amount of quaternization of the amino groups in the polymer, i.e. the amount of quaternized moieties. The amount of the quaternized moieties can be calculated from the difference of the amine number in the non-quaternized amine and the quaternized amine. The amine number can be determined according to the method described in DIN 16945.

The reaction may be carried out without any solvent. However, a solvent or diluent like water, acetonitrile, dimethylsulfoxide, N-Methylpyrrolidone, etc. may be used. The reaction temperature is usually in the range from 10° C. to 150° C. and is preferably from 50° C. to 100° C.

In some aspects, the inventive quaternized polyalkylenimines may be sulfatized or transsulfatized if $R^2$ in formula II is hydrogen. Typically, the inventive quaternized polyalkylenimines are sulfatized or transsulfatized. The quaternized polyalkylenimines can be sulfatized or transsulfatized in accordance with methods known in the art, e.g. as described in WO 05/092952. Sulfatation or transsulfatation can be achieved with e.g. dimethylsulfate.

The sulfation of the polymers according to the present invention can be affected by a reaction with sulfuric acid or with a sulfuric acid derivative. Suitable sulfation agents are e.g. sulfuric acid (preferably 75% to 100% strength, more preferably 85% to 98% strength), oleum, $SO_3$, chlorosulfonic acid, sulfuryl chloride, amidosulfuric acid, and the like. If sulfuryl chloride is being used as sulfation agent, the remaining chlorine is being replaced by hydrolysis after sulfation. The sulfation agent is frequently used in equimolar amounts or in excess, e.g. 1 to 1.5 moles per OH-group present in the polymer. But, the sulfation agent can also be used in sub-equimolar amounts. The sulfation can be effected in the presence of a solvent. A suitable solvent is e.g. toluene. After the sulfation the reaction mixture is generally neutralized and worked up in a conventional manner.

As described above, it is also possible to quaternize and transsulfatize alkoxylated polyalkylenimines A sulfation process can be described as transsulfation process, when an alkoxylated polyalkylenimine is first reacted with a di-$C_1$-$C_4$-alkyl sulfate to form a quaternized polyalkylenimine and a sulfating species as counterion, and then followed by reacting the hydroxyl groups with the sulfating species, leading to a quaternized and sulfated alkoxylated polyalkylenimine Examples for transsulfation processes are described in WO 04/024858 or WO 02/12180.

Combined quaternization and sulfatization can be achieved, e.g., by first reacting an alkoxylated polyalkylenimine with a di-$C_1$-$C_4$-alkyl sulfate in the presence of a base, then acidifying the reaction mixture obtained from quaternization, for example with an organic acid, such as methane sulfonic acid, or with a mineral acid such as phosphoric acid, sulfuric acid or hydrochloric acid. The process is conducted at a pH less than 6, preferably less than pH 3, at temperatures from 0° C.-200° C., preferably 50-150° C. After the transsulfation the reaction mixture is generally neutralized.

In some aspects, the alkoxylated polyalkylenimine is additionally quaternized and/or sulfatized.

The alkoxylated polyalkylenimines may be prepared in a known manner. One typical procedure consists in initially undertaking only an incipient alkoxylation of the polyalkylenimine in a first step. Thus, the present invention further relates to a process for preparing a water-soluble alkoxylated polyalkyleneimine according to the present invention, wherein a polyalkyleneimine is first reacted with ethylene oxide, then with propylene oxide or butylene oxide, and then with ethylene oxide.

In the first step, the polyalkylenimine is reacted only with a portion of the total amount of ethylene oxide used, which corresponds to about 1 mol of ethylene oxide per mole of NH moiety.

In some aspects, per mol of N—H functionalities in the polyalkyleneimine, the polyalkyleneimine is reacted with 5 to 18 moles ethylene oxide, then with 1 to 5 moles propylenoxide or butylene oxide, and then with 2 to 14 moles ethylene oxide.

In certain aspects, the polyalkylenimine is a polyethyleneimine.

This reaction is undertaken generally in the absence of a catalyst in aqueous solution at from about 70 to about 200° C., or from about 80 to about 160° C., under a pressure of up to about 10 bar, in particular up to about 8 bar.

In a second step, the further alkoxylation is then performed by subsequent reaction i) with the remaining amount of ethylene oxide; ii) with propylene oxide or, in the case of a modification by a higher alkylene oxide, with butylene oxide and/or pentene oxide; and, finally, iii) with ethylene oxide.

The second step of the alkoxylation reaction is undertaken typically in the presence of a basic catalyst. Examples of suitable catalysts are alkali metal and alkaline earth metal hydroxides, such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides such as sodium hydride and calcium hydride, and alkali metal carbonates such as sodium carbonate and potassium carbonate. In some aspects, the basic catalyst is selected from the alkali metal hydroxides or the alkali metal alkoxides, in particular potassium hydroxide or sodium hydroxide. Typical use amounts for the basic catalyst are from about 0.05 to about 10% by weight, in particular from about 0.5 to about 2% by weight, based on the total amount of polyalkylenimine and alkylene oxide.

The further alkoxylation may be undertaken in substance (variant a)) or in an organic solvent (variant b)). The process conditions specified below may be used both for steps of the alkoxylation reaction.

In variant a), the aqueous solution of the incipiently alkoxylated polyalkylenimine obtained in the first step, after addition of the catalyst, is initially dewatered. This can be done in a simple manner by heating to from about 80 to about 150° C. and distilling off the water under a reduced pressure of less than about 30 mbar. The subsequent reactions with the alkylene oxides are performed typically at from about 70 to about 200° C., or from about 100 to about 180° C., and at a pressure of up to about 10 bar, in particular up to about 8 bar, and a continued stirring time of about 0.5 to about 4 h at from about 100 to about 160° C. and constant pressure follows in each case.

Suitable reaction media for variant b) are in particular nonpolar and polar aprotic organic solvents. Examples of particularly suitable nonpolar aprotic solvents include aliphatic and aromatic hydrocarbons such as hexane, cyclohexane, toluene and xylene. Examples of particularly suitable polar aprotic solvents are ethers, in particular cyclic ethers, such as tetrahydrofuran and dioxane, N,N-dialkylamides such as dimethylformamide and dimethylacetamide, and N-alkyllactams such as N-methylpyrrolidone. It is also possible to use mixtures of these aprotic solvents. Particularly suitable solvents are xylene and toluene.

In variant b) too, the solution obtained in the first step, after addition of catalyst and solvent, is initially dewatered, which is advantageously done by separating out the water at a temperature of from about 120 to about 180° C., typically supported by a gentle nitrogen stream. The subsequent reaction with the alkylene oxide may be performed as in variant a).

In variant a), the alkoxylated polyalkylenimine is obtained directly in substance and may be converted if desired to an aqueous solution. In variant b), the organic solvent is typically removed and replaced by water. The products may also be isolated in substance.

In some aspects, the inventive polymers have a melting point lower than 25° C., so that they are liquid at room temperature. This enables easier handling since they do not have to be melted or solubilized in aqueous solution before further processing.

In some aspects, the alkoxylated polyalkylenimines have a weight average molecular weight of from about 1500 to about 100,000 g/mol, or from about 5000 to about 50,000 g/mol, or from about 10,000 to about 40,000 g/mol, or from about 20,000 to about 30,000 g/mol.

The alkoxylated polyalkylenimines may be present in a cleaning composition at a concentration of from about 0.1% to about 5% by weight of the composition, or at a concentration of from about 0.5% to about 2% by weight of the composition.

Surfactant System

The cleaning compositions comprise a surfactant system in an amount sufficient to provide desired cleaning properties. In some embodiments, the cleaning composition comprises, by weight of the composition, from about 1% to about 70% of a surfactant system. In other embodiments, the liquid cleaning composition comprises, by weight of the composition, from about 2% to about 60% of the surfactant system. In further embodiments, the cleaning composition comprises, by weight of the composition, from about 5% to about 30% of the surfactant system. The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material.

Anionic Surfactants

In some examples, the surfactant system of the cleaning composition may comprise from about 1% to about 70%, by weight of the surfactant system, of one or more anionic surfactants. In other examples, the surfactant system of the cleaning composition may comprise from about 2% to about 60%, by weight of the surfactant system, of one or more anionic surfactants. In further examples, the surfactant system of the cleaning composition may comprise from about 5% to about 30%, by weight of the surfactant system, of one or more anionic surfactants. In further examples, the surfactant system may consist essentially of, or even consist of one or more anionic surfactants.

Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide.

Non-ethoxylated alkyl sulfates may also be added to the disclosed cleaning compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration, e.g. those of the type described in U.S. Pat. Nos. 2,220,099 and 2,477,383. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS. Such surfactants and their preparation are described for example in U.S. Pat. Nos. 2,220,099 and 2,477,383.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants useful herein may be found in U.S. Pat. No. 4,285,841, Banat et al., issued Aug. 25, 1981, and in U.S. Pat. No. 3,919,678, Laughlin, et al., issued Dec. 30, 1975, both of which are herein incorporated by reference.

Nonionic Surfactants

The surfactant system of the cleaning composition may comprise a nonionic surfactant. In some examples, the surfactant system comprises up to about 25%, by weight of the surfactant system, of one or more nonionic surfactants, e.g., as a co-surfactant. In some examples, the cleaning compositions comprises from about 0.1% to about 15%, by weight of the surfactant system, of one or more nonionic surfactants. In further examples, the cleaning compositions comprises from about 0.3% to about 10%, by weight of the surfactant system, of one or more nonionic surfactants.

Suitable nonionic surfactants useful herein can comprise any conventional nonionic surfactant. These can include, for e.g., alkoxylated fatty alcohols and amine oxide surfactants. In some examples, the cleaning compositions may contain an ethoxylated nonionic surfactant. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Anionic/Nonionic Combinations

The surfactant system may comprise combinations of anionic and nonionic surfactant materials. In some examples, the weight ratio of anionic surfactant to nonionic surfactant is at least about 2:1. In other examples, the weight ratio of anionic surfactant to nonionic surfactant is at least about 5:1. In further examples, the weight ratio of anionic surfactant to nonionic surfactant is at least about 10:1.

Cationic Surfactants

The surfactant system may comprise a cationic surfactant. In some aspects, the surfactant system comprises from about 0% to about 7%, or from about 0.1% to about 5%, or from about 1% to about 4%, by weight of the surfactant system, of a cationic surfactant, e.g., as a co-surfactant. In some aspects, the cleaning compositions of the invention are substantially free of cationic surfactants and surfactants that become cationic below a pH of 7 or below a pH of 6.

Non-limiting examples of cationic include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides (e.g., $C_{12-14}$ dimethyl amine oxide) and sulfo and hydroxy betaines, such as N-alkyl-N, N-dimethylammino-1-propane sulfonate where the alkyl group can be $C_8$ to $C_{18}$ and in certain embodiments from $C_{10}$ to $C_{14}$.

Ampholytic Surfactants

Specific, non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Amphoteric Surfactants

Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino) ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. See U.S. Pat. No. 3,929,678 to Laughlin et al., issued Dec. 30, 1975 at column 19, lines 18-35, for examples of amphoteric surfactants.

In one aspect, the surfactant system comprises an anionic surfactant and, as a co-surfactant, a nonionic surfactant, for example, a $C_{12}$-$C_{18}$ alkyl ethoxylate. In another aspect, the surfactant system comprises $C_{10}$-$C_{15}$ alkyl benzene sulfonates (LAS) and, as a co-surfactant, an anionic surfactant, e.g., $C_{10}$-$C_{18}$ alkyl alkoxy sulfates ($AE_xS$), where x is from 1-30. In another aspect, the surfactant system comprises an anionic surfactant and, as a co-surfactant, a cationic surfactant, for example, dimethyl hydroxyethyl lauryl ammonium chloride.

Branched Surfactants

Suitable branched detersive surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-ylsuccinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

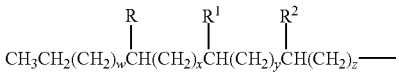

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

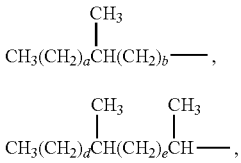

(I)

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

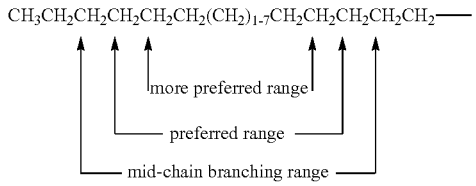

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

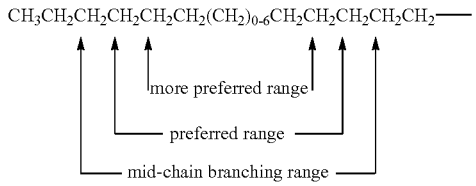

Additional suitable branched surfactants are disclosed in U.S. Pat. No. 6,008,181, U.S. Pat. No. 6,060,443, U.S. Pat. No. 6,020,303, U.S. Pat. No. 6,153,577, U.S. Pat. No. 6,093,856, U.S. Pat. No. 6,015,781, U.S. Pat. No. 6,133,222, U.S. Pat. No. 6,326,348, U.S. Pat. No. 6,482,789, U.S. Pat. No. 6,677,289, U.S. Pat. No. 6,903,059, U.S. Pat. No. 6,660,711, U.S. Pat. No. 6,335,312, and WO 9918929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233 (P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP1080084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (ExxonMobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), US6703535B2 (CHEVRON), EP1140741B1 (BASF), WO2003095402A1 (OXENO), US6765106B2 (SHELL), US20040167355A1 (NONE), US6700027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference.

Further suitable branched anionic detersive surfactants include those derived from anteiso and iso-alcohols. Such surfactants are disclosed in WO2012009525.

Additional suitable branched anionic detersive surfactants include those described in US Patent Application Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Adjunct Cleaning Additives

The cleaning compositions of the invention may also contain adjunct cleaning additives. Suitable adjunct cleaning additives include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds supressors, softeners, and perfumes.

Enzymes

The cleaning compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a consumer product, the aforementioned additional enzymes may be present at levels from about 0.00001% to about 2%, from about 0.0001% to about 1% or even from about 0.001% to about 0.5% enzyme protein by weight of the consumer product.

In one aspect preferred enzymes would include a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044993A2.

Preferred proteases include those derived from *Bacillus gibsonii* or *Bacillus Lentus*.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the folowing mutations S99D+S101R+S103A+V104I+G159S, hereinafter referred to as BLAP), BLAP R (BLAP with S3T+V4I+V199M+V2051+L217D), BLAP X (BLAP with S3T+V4I+V2051) and BLAP F49 (BLAP with S3T+V4I+A194P+V199M+V2051+L217D)— all from Henkel/Kemira; and KAP (*Bacillus alkalophilus* subtilisin with mutations A230V+S256G+S259N) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one or more of M202L, M202V, M202S, M202T, M202I, M202Q, M202W, S255N and/or R172Q. Particularly preferred are those comprising the M202 L or M202T mutations.

(e) variants described in WO 09/149130, preferably those exhibiting at least 90% identity with SEQ ID NO: 1 or SEQ ID NO:2 in WO 09/149130, the wild-type enzyme from *Geobacillus* Stearophermophilus or a truncated version thereof.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS® and mixtures thereof.

In one aspect, such enzymes may be selected from the group consisting of: lipases, including "first cycle lipases" such as those described in U.S. Pat. No. 6,939,702 B1 and US PA 2009/0217464. In one aspect, the lipase is a first-wash lipase, preferably a variant of the wild-type lipase from *Thermomyces lanuginosus* comprising one or more of the T231R and N233R mutations. The wild-type sequence is the 269 amino acids (amino acids 23-291) of the Swissprot accession number Swiss-Prot O59952 (derived from *Thermomyces lanuginosus* (*Humicola lanuginosa*)). Preferred lipases would include those sold under the tradenames Lipex® and Lipolex®.

In one aspect, other preferred enzymes include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403B2) and mixtures thereof. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Enzyme Stabilizing System

The enzyme-containing compositions described herein may optionally comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the cleaning composition. See U.S. Pat. No. 4,537,706 for a review of borate stabilizers.

Builders

The cleaning compositions of the present invention may optionally comprise a builder. Built cleaning compositions typically comprise at least about 1% builder, based on the total weight of the composition. Liquid cleaning compositions may comprise up to about 10% builder, and in some examples up to about 8% builder, of the total weight of the composition. Granular cleaning compositions may comprise up to about 30% builder, and in some examples up to about 5% builder, by weight of the composition.

Builders selected from aluminosilicates and silicates assist in controlling mineral hardness in wash water, especially calcium and/or magnesium, or to assist in the removal of particulate soils from surfaces. Suitable builders may be selected from the group consisting of phosphates polyphosphates, especially sodium salts thereof; carbonates, bicarbonates, sesquicarbonates, and carbonate minerals other than sodium carbonate or sesquicarbonate; organic mono-, di-, tri-, and tetracarboxylates, especially water-soluble non-surfactant carboxylates in acid, sodium, potassium or alkanolammonium salt form, as well as oligomeric or water-soluble low molecular weight polymer carboxylates, including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing cleaning compositions. Other builders can be selected from the polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2.zM'O$ wherein M is Na and/or K, M' is Ca and/or Mg; y/x is 0.5 to 2.0; and z/x is 0.005 to 1.0 as taught in U.S. Pat. No. 5,427,711.

Structurant/Thickeners i. Di-benzylidene Polyol Acetal Derivative

The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. Non-limiting examples of suitable DBPA molecules are disclosed in U.S. 61/167,604. In one aspect, the DBPA derivative may comprise a dibenzylidene sorbitol acetal derivative (DBS). Said DBS derivative may be selected from the group consisting of: 1,3:2,4-dibenzylidene sorbitol; 1,3:2,4-di(p-methylbenzylidene) sorbitol; 1,3:2,4-di(p-chlorobenzylidene) sorbitol; 1,3:2,4-di(2,4-dimethyldibenzylidene) sorbitol; 1,3:2,4-di(p-ethylbenzylidene) sorbitol; and 1,3:2,4-di(3,4-dimethyldibenzylidene) sorbitol or mixtures thereof. These and other suitable DBS derivatives are disclosed in U.S. Pat. No. 6,102,999, column 2 line 43 to column 3 line 65.

ii. Bacterial Cellulose

The fluid detergent composition may also comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. Some examples of suitable bacterial cellulose can be found in U.S. Pat. No. 6,967,027; U.S. Pat. No. 5,207,826; U.S. Pat. No. 4,487,634; U.S. Pat. No. 4,373,702; U.S. Pat. No. 4,863,565 and US 2007/0027108. In one aspect, said fibres have cross sectional dimensions of 1.6 nm to 3.2 nm by 5.8 nm to 133 nm. Additionally, the bacterial cellulose fibres have an average microfibre length of at least about 100 nm, or from about 100 to about 1,500 nm. In one aspect, the bacterial cellulose microfibres have an aspect ratio, meaning the average microfibre length divided by the widest cross sectional microfibre width, of from about 100:1 to about 400:1, or even from about 200:1 to about 300:1.

iii. Coated Bacterial Cellulose

In one aspect, the bacterial cellulose is at least partially coated with a polymeric thickener. The at least partially coated bacterial cellulose can be prepared in accordance with the methods disclosed in US 2007/0027108 paragraphs 8 to 19. In one aspect the at least partially coated bacterial cellulose comprises from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

iv. Cellulose Fibers Non-Bacterial Cellulose Derived

In one aspect, the composition may further comprise from about 0.01 to about 5% by weight of the composition of a cellulosic fiber. Said cellulosic fiber may be extracted from vegetables, fruits or wood. Commercially available examples are Avicel® from FMC, Citri-Fi from Fiberstar or Betafib from Cosun.

v. Non-Polymeric Crystalline Hydroxyl-Functional Materials

In one aspect, the composition may further comprise from about 0.01 to about 1% by weight of the composition of a non-polymeric crystalline, hydroxyl functional structurant. Said non-polymeric crystalline, hydroxyl functional structurants generally may comprise a crystallizable glyceride which can be pre-emulsified to aid dispersion into the final fluid detergent composition. In one aspect, crystallizable glycerides may include hydrogenated castor oil or "HCO" or derivatives thereof, provided that it is capable of crystallizing in the liquid detergent composition.

vi. Polymeric Structuring Agents

Fluid detergent compositions of the present invention may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof. In one aspect, said polycarboxylate polymer is a polyacrylate, polymethacrylate or mixtures thereof. In another aspect, the polyacrylate is a copolymer of unsaturated mono- or di-carbonic acid and $C_1$-$C_{30}$ alkyl ester of the (meth)acrylic acid. Said copolymers are available from Noveon inc under the tradename Carbopol Aqua 30.

vii. Di-amido-gellants

In one aspect, the external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. In one aspect, the amido groups are different. In another aspect, the amido functional groups are the same. The di-amido gellant has the following formula:

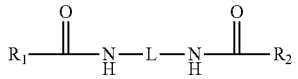

wherein:

$R_1$ and $R_2$ is an amino functional end-group, or even amido functional end-group, in one aspect $R_1$ and $R_2$ may comprise a pH-tuneable group, wherein the pH tuneable amido-gellant may have a pKa of from about 1 to about 30, or even from about 2 to about 10. In one aspect, the pH tuneable group may comprise a pyridine. In one aspect, $R_1$ and $R_2$ may be different. In another aspect, may be the same.

L is a linking moeity of molecular weight from 14 to 500 g/mol. In one aspect, L may comprise a carbon chain comprising between 2 and 20 carbon atoms. In another aspect, L may comprise a pH-tuneable group. In one aspect, the pH tuneable group is a secondary amine.

In one aspect, at least one of $R_1$, $R_2$ or L may comprise a pH-tuneable group.

Non-limiting examples of di-amido gellants are:

N,N'-(2S,2'S)-1,1'-(dodecane-1,12-diylbis(azanediyl) bis(3-methyl-1-oxobutane-2,1-diyl)diisonicotinamide

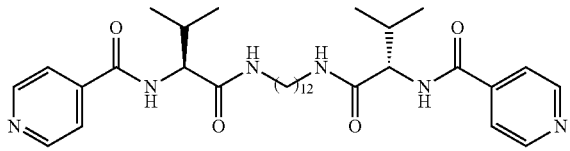

dibenzyl (2S,2'S)-1,1'-(propane-1,3-diylbis (azanediyl))bis(3-methyl-1-oxobutane-2,1-diyl)dicarbamate

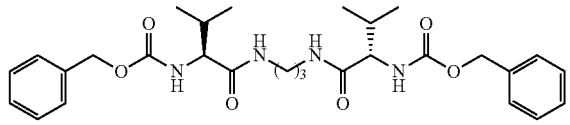

dibenzyl (2S,2'S)-1,1'-(dodecane-1,12-diylbis (azanediyl)bis(1-oxo-3-phenylpropane-2,1-diyl)dicarbamate

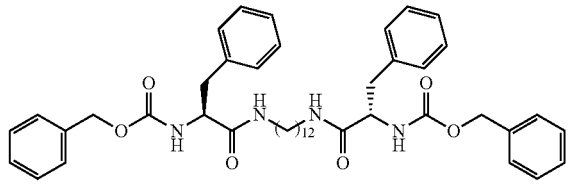

Polymeric Dispersing Agents

The detergent composition may comprise one or more polymeric dispersing agents. Examples are carboxymethylcellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The detergent composition may comprise an amphiphilic alkoxylated grease cleaning polymers, which have balanced hydrophilic and hydrophobic properties such that they remove grease particles from fabrics and surfaces. Amphiphilic alkoxylated grease cleaning polymers may comprise a core structure and a plurality of alkoxylate groups attached to the core structure.

The detergent composition may comprise an additional alkoxylated polyalkylenimine, for example, one having an inner polyethylene oxide block and an outer polypropylene oxide block. Such compounds may include, but are not limited to, ethoxylated polyethyleneimine or quaternized and/or sulfated versions thereof. Polypropoxylated derivatives may also be included. A useful example is 600 g/mol polyethyleneimine core ethoxylated to 20 EO groups per NH and is available from BASF.

Alkoxylated polycarboxylates such as those prepared from polyacrylates are useful herein to provide additional grease removal performance. Such materials are described in WO 91/08281 and PCT 90/01815. Chemically, these materials comprise polyacrylates having one ethoxy side-chain per every 7-8 acrylate units. The side-chains are of the formula $—(CH_2CH_2O)_m(CH_2)_nCH_3$ wherein m is 2-3 and n is 6-12. The side-chains are ester-linked to the polyacrylate "backbone" to provide a "comb" polymer type structure. The molecular weight can vary, but is typically in the range of about 2000 to about 50,000. The detergent compositions described herein may comprise from about 0.1% to about 10%, and in some examples, from about 0.25% to about 5%, and in other examples, from about 0.3% to about 2%, by weight of the cleaning composition, of alkoxylated polycarboxylates.

Suitable amphilic graft co-polymer preferable include the amphilic graft co-polymer comprises (i) polyethyelene glycol backbone; and (ii) and at least one pendant moiety selected from polyvinyl acetate, polyvinyl alcohol and mixtures thereof. A preferred amphilic graft co-polymer is Sokalan® HP22, supplied from BASF. Suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Carboxylate polymer—The detergent compositions of the present invention may also include one or more carboxylate polymers such as a maleate/acrylate random copolymer or polyacrylate homopolymer. In one aspect, the carboxylate polymer is a polyacrylate homopolymer having a molecular weight of from 4,000 Da to 9,000 Da, or from 6,000 Da to 9,000 Da.

Soil release polymer—The detergent compositions of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic polymer—The consumer products of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Examples of polymeric dispersing agents are found in U.S. Pat. No. 3,308,067, European Patent Application No. 66915, EP 193,360, and EP 193,360.

Additional Amines

Additional amines may be used in the cleaning compositions described herein for added removal of grease and particulates from soiled materials. The cleaning compositions described herein may comprise from about 0.1% to about 10%, in some examples, from about 0.1% to about 4%, and in other examples, from about 0.1% to about 2%, by weight of the cleaning composition, of additional amines. Non-limiting examples of additional amines may include, but are not limited to, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof Bleaching Compounds, Bleaching Agents, Bleach Activators, and Bleach Catalysts The cleaning compositions described herein may contain bleaching agents or bleaching compositions containing a bleaching agent and one or more bleach activators. Bleaching agents may be present at levels of from about 1% to about 30%, and in some examples from about 5% to about 20%, based on the total weight of the composition. If present, the amount of bleach activator may be from about 0.1% to about 60%, and in some examples from about 0.5% to about 40%, of the bleaching composition comprising the bleaching agent plus bleach activator.

Examples of bleaching agents include oxygen bleach, perborate bleach, percarboxylic acid bleach and salts thereof, peroxygen bleach, persulfate bleach, percarbonate bleach, and mixtures thereof. Examples of bleaching agents are disclosed in U.S. Pat. No. 4,483,781, U.S. patent application Ser. No. 740,446, European Patent Application 0,133,354, U.S. Pat. No. 4,412,934, and U.S. Pat. No. 4,634,551.

Examples of bleach activators (e.g., acyl lactam activators) are disclosed in U.S. Pat. Nos. 4,915,854; 4,412,934; 4,634,551; 4,634,551; and 4,966,723.

In some examples, cleaning compositions may also include a transition metal bleach catalyst. In other examples, the transition metal bleach catalyst may be encapsulated. The transition metal bleach catalyst may comprise a transition metal ion, which may be selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). The transition metal bleach catalyst may comprise a ligand, such as a macropolycyclic ligand or a cross-bridged macropolycyclic ligand. The transition metal ion may be coordinated with the ligand. The ligand may comprise at least four donor atoms, at least two of which are bridgehead donor atoms. Suitable transition metal bleach catalysts are described in U.S. Pat. No. 5,580,485, U.S. Pat. No. 4,430,243; U.S. Pat. No. 4,728,455; U.S. Pat. No. 5,246,621; U.S. Pat. No. 5,244,594; U.S. Pat. No. 5,284,944; U.S. Pat. No. 5,194,416; U.S. Pat. No. 5,246,612; U.S. Pat. No. 5,256,779; U.S. Pat. No. 5,280,117; U.S. Pat. No. 5,274,147; U.S. Pat. No. 5,153,161; U.S. Pat. No. 5,227,084; U.S. Pat. No. 5,114,606; U.S. Pat. No. 5,114,611, EP 549,271 A1; EP 544,490 A1; EP 549,272 A1; and EP 544,440 A2. Another suitable transition metal bleach catalyst is a manganese-based catalyst, as is disclosed in U.S. Pat. No. 5,576,282. Suitable cobalt bleach catalysts are described, for example, in U.S. Pat. No. 5,597,936 and U.S. Pat. No. 5,595,967. Such cobalt catalysts are readily prepared by known procedures, such as taught for example in U.S. Pat. No. 5,597,936, and U.S. Pat. No. 5,595,967. A suitable transition metal bleach catalyst is a transition metal complex of ligand such as bispidones described in WO 05/042532 A1.

Bleaching agents other than oxygen bleaching agents are also known in the art and can be utilized in cleaning compositions. They include, for example, photoactivated bleaching agents such as the sulfonated zinc and/or aluminum phthalocyanines described in U.S. Pat. No. 4,033,718, or pre-formed organic peracids, such as peroxycarboxylic acid or salt thereof, or a peroxysulphonic acid or salt thereof. A suitable organic peracid is phthaloylimidoperoxycaproic acid. If used, the cleaning compositions described herein will typically contain from about 0.025% to about 1.25%, by weight of the composition, of such bleaches, and in some examples, of sulfonate zinc phthalocyanine.

Brighteners

Optical brighteners or other brightening or whitening agents may be incorporated at levels of from about 0.01% to about 1.2%, by weight of the composition, into the cleaning compositions described herein. Commercial optical brighteners, which may be used herein, can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents," M. Zahradnik, John Wiley & Sons, New York (1982). Specific, non-limiting examples of optical brighteners which may be useful in the present compositions are those identified in U.S. Pat. No. 4,790,856 and U.S. Pat. No. 3,646,015.

Fabric Hueing Agents

The compositions may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet Conn., carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Dye Transfer Inhibiting Agents

Fabric cleaning compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.01% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof. Non-limiting examples of chelants of use in the present invention are found in U.S. Pat. No. 7,445,644, U.S. Pat. No. 7,585,376 and U.S. Publication 2009/0176684A1.

Aminocarboxylates useful as chelating agents include, but are not limited to ethylenediaminetetracetates (EDTA); N-(hydroxyethyl)ethylenediaminetriacetates (HEDTA); nitrilotriacetates (NTA); ethylenediamine tetraproprionates; triethylenetetraaminehexacetates, diethylenetriamine-pentaacetates (DTPA); methylglycinediacetic acid (MGDA); Glutamic acid diacetic acid (GLDA); ethanoldiglycines; triethylenetetraaminehexaacetic acid (TTHA); N-hydroxyethyliminodiacetic acid (HEIDA); dihydroxyethylglycine (DHEG); ethylenediaminetetrapropionic acid (EDTP) and derivatives thereof.

Phosphorus containing chelants include, but are not limited to diethylene triamine penta (methylene phosphonic acid) (DTPMP CAS 15827-60-8); ethylene diamine tetra (methylene phosphonic acid) (EDTMP CAS 1429-50-1); 2-Phosphonobutane 1,2,4-tricarboxylic acid (Bayhibit® AM); hexamethylene diamine tetra(methylene phosphonic acid) (CAS 56744-47-9); hydroxy-ethane diphosphonic acid (HEDP CAS 2809-21-4); hydroxyethane dimethylene phosphonic acid; 2-phosphono-1,2,4-Butanetricarboxylic acid (CAS 37971-36-1); 2-hydroxy-2-phosphono-Acetic acid (CAS 23783-26-8); Aminotri(methylenephosphonic acid) (ATMP CAS 6419-19-8); P,P'-(1,2-ethanediyl)bis-Phosphonic acid (CAS 6145-31-9); P,P'-methylenebis-Phosphonic acid (CAS 1984-15-2); Triethylenediaminetetra(methylene phosphonic acid) (CAS 28444-52-2); P-(1-hydroxy-1-methylethyl)-Phosphonic acid (CAS 4167-10-6); bis (hexamethylene triamine penta(methylenephosphonic acid)) (CAS 34690-00-1); N2,N2,N6,N6-tetrakis(phosphonomethyl)-Lysine (CAS 194933-56-7, CAS 172780-03-9), salts thereof, and mixtures thereof. Preferably, these aminophosphonates do not contain alkyl or alkenyl groups with more than about 6 carbon atoms.

A biodegradable chelator that may also be used herein is ethylenediamine disuccinate ("EDDS"). In some examples, but of course not limited to this particular example, the [S,S] isomer as described in U.S. Pat. No. 4,704,233 may be used. In other examples, the trisodium salt of EDDA may be used, though other forms, such as magnesium salts, may also be useful. Polymeric chelants such as Trilon P® from BASF may also be useful.

Polyfunctionally-substituted aromatic chelating agents may also be used in the cleaning compositions. See U.S. Pat. No. 3,812,044, issued May 21, 1974, to Connor et al. Compounds of this type in acid form are dihydroxydisulfobenzenes, such as 1,2-dihydroxy-3,5-disulfobenzene, also known as Tiron. Other sulphonated catechols may also be used. In addition to the disulfonic acid, the term "tiron" may also include mono- or di-sulfonate salts of the acid, such as, for example, the disodium sulfonate salt, which shares the same core molecular structure with the disulfonic acid.

The detergent composition according to the present invention may comprise a substituted or unsubstituted 2-pyridinol-N-oxide compound or a salt thereof, as a chelating agent. Included within the scope of this invention are tautomers of this compound, e.g., 1-Hydroxy-2(1H)-pyridinone, as chelating agents. In certain aspects, the detergent composition comprises a 2-pyridinol-N-oxide compound selected from the group consisting of: 2-hydroxypyridine-1-oxide; 3-pyridinecarboxylic acid, 2-hydroxy-, 1-oxide; 6-hydroxy-3-pyridinecarboxylic acid, 1-oxide; 2-hydroxy-4-pyridinecarboxylic acid, 1-oxide; 2-pyridinecarboxylic acid, 6-hydroxy-, 1-oxide; 6-hydroxy-3-pyridinesulfonic acid, 1-oxide; and mixtures thereof. In certain aspects, the detergent composition comprises a 1-Hydroxy-2(1H)-pyridinone compound selected from the group consisting of: 1-Hydroxy-2(1H)-pyridinone (CAS 822-89-9); 1,6-dihydro-1-hydroxy-6-oxo-3-Pyridinecarboxylic acid (CAS 677763-18-7); 1,2-dihydro-1-hydroxy-2-oxo-4-Pyridinecarboxylic acid (CAS 119736-22-0); 1,6-dihydro-1-hydroxy-6-oxo-2-Pyridinecarboxylic acid (CAS 94781-89-2); 1-hydroxy-4-methyl-6-(2,4,4-trimethylpentyl)-2(1H)-Pyridinone (CAS 50650-76-5); 6-(cyclohexylmethyl)-1-hydroxy-4-methyl-2(1H)-Pyridinone (CAS 29342-10-7); 1-hydroxy-4,6-dimethyl-2(1H)-Pyridinone (CAS 29342-02-7); 1-Hydroxy-4-methyl-6-(2,4,4-trimethylpentyl)-2-pyridone monoethanolamine (CAS 68890-66-4); 1-hydroxy-6-(octyloxy)-2(1H)-Pyridinone (CAS 162912-64-3); 1-Hydroxy-4-methyl-6-cyclohexyl-2-pyridinone ethanolamine salt (CAS 41621-49-2); 1-Hydroxy-4-methyl-6-cyclohexyl-2-pyridinone (CAS 29342-05-0); 6-ethoxy-1,2-dihydro-1-hydroxy-2-oxo-4-Pyridinecarboxylic acid,methyl ester (CAS 36979-78-9); 1-hydroxy-5-nitro-2(1H)-Pyridinone (CAS 45939-70-6); and mixtures thereof. These compounds are commercially available from, for example, Sigma-Aldrich (St. Louis, Mo.), Princeton Building Blocks (Monmouth Junction, N.J.), 3B Scientific Corporation (Libertyville, Ill.), SynFine Research (Richmond Hill, ON), Ryan Scientific, Inc. (Mt. Pleasant, S.C.), and/or Aces Pharma (Branford, Conn.).

Hydroxamic acids are a class of chemical compounds in which a hydroxylamine is inserted into a carboxylic acid and be used as chelating agents. The general structure of a hydroxamic acid is the following:

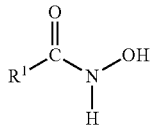

The preferred hydroxamates are those where $R^1$ is C4 to C14 alkyl, preferably normal alkyl, most preferably saturated, salts thereof and mixtures thereof. When the C8 material is used, it called octyl hydroxamic acid.

Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Water-Soluble Film

The compositions of the present invention may also be encapsulated within a water-soluble film. Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More prefened polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. Naturally, different film material and/or films of different thickness may be employed in making the compartments of the present invention. A benefit in selecting different films is that the resulting compartments may exhibit different solubility or release characteristics.

Most preferred film materials are PVA films known under the MonoSol trade reference M8630, M8900, H8779 (as described in the Applicants co-pending applications ref 44528 and 11599) and those described in U.S. Pat. No. 6,166,117 and U.S. Pat. No. 6,787,512 and PVA films of corresponding solubility and deformability characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

Suds Suppressors

Compounds for reducing or suppressing the formation of suds can be incorporated into the cleaning compositions described herein. Suds suppression can be of particular importance in the so-called "high concentration cleaning process" as described in U.S. Pat. Nos. 4,489,455, 4,489,574, and in front-loading style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols. Suds supressors are described in U.S. Pat. Nos. 2,954,347; 4,265,779; 4,265,779; 3,455,839; 3,933,672; 4,652,392; 4,978,471; 4,983,316; 5,288,431; 4,639,489; 4,749,740; and 4,798,679; 4,075,118; European Patent Application No. 89307851.9; EP 150,872; and DOS 2,124,526.

The cleaning compositions herein may comprise from 0% to about 10%, by weight of the composition, of suds suppressor. When utilized as suds suppressors, monocarboxylic fatty acids, and salts thereof, may be present in amounts of up to about 5% by weight of the cleaning composition, and in some examples, from about 0.5% to about 3% by weight of the cleaning composition. Silicone suds suppressors may be utilized in amounts of up to about 2.0% by weight of the cleaning composition, although higher amounts may be used. Monostearyl phosphate suds suppressors may be utilized in amounts ranging from about 0.1% to about 2% by weight of the cleaning composition. Hydrocarbon suds suppressors may be utilized in amounts ranging from about 0.01% to about 5.0% by weight of the cleaning composition, although higher levels can be used. Alcohol suds suppressors may be used at a concentration ranging from about 0.2% to about 3% by weight of the cleaning composition.

Suds Boosters

If high sudsing is desired, suds boosters such as the $C_{10}$-$C_{16}$ alkanolamides may be incorporated into the cleaning compositions at a concentration ranging from about 1% to about 10% by weight of the cleaning composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the cleaning composition, to provide additional suds and to enhance grease removal performance.

Fabric Softeners

Various through-the-wash fabric softeners, including the impalpable smectite clays of U.S. Pat. No. 4,062,647 as well as other softener clays known in the art, may be used at levels of from about 0.5% to about 10% by weight of the composition, to provide fabric softener benefits concurrently with fabric cleaning. Clay softeners can be used in combination with amine and cationic softeners as disclosed, for example, in U.S. Pat. No. 4,375,416, and U.S. Pat. No. 4,291,071. Cationic softeners can also be used without clay softeners.

Encapsulates

The compositions may comprise an encapsulate. In some aspects, the encapsulate comprises a core, a shell having an inner and outer surface, where the shell encapsulates the core.

In certain aspects, the encapsulate comprises a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other comonomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. In some aspects, where the shell comprises an aminoplast, the aminoplast comprises polyurea, polyurethane, and/or polyureaurethane. The polyurea may comprise polyoxymethyleneurea and/or melamine formaldehyde.

In some aspects, the encapsulate comprises a core, and the core comprises a perfume. In certain aspects, the encapsulate comprises a shell, and the shell comprises melamine formaldehyde and/or cross linked melamine formaldehyde. In some aspects, the encapsulate comprises a core comprising a perfume and a shell comprising melamine formaldehyde and/or cross linked melamine formaldehyde Suitable encapsulates may comprise a core material and a shell, where the shell at least partially surrounds the core material. At least 75%, or at least 85%, or even at least 90% of the encapsulates may have a fracture strength of from about 0.2 MPa to about 10 MPa, from about 0.4 MPa to about 5 MPa, from about 0.6 MPa to about 3.5 MPa, or even from about 0.7 MPa to about 3 MPa; and a benefit agent leakage of from 0% to about 30%, from 0% to about 20%, or even from 0% to about 5%.

In some aspects, at least 75%, 85% or even 90% of said encapsulates may have a particle size of from about 1 microns to about 80 microns, about 5 microns to 60 microns, from about 10 microns to about 50 microns, or even from about 15 microns to about 40 microns.

In some aspects, at least 75%, 85% or even 90% of said encapsulates may have a particle wall thickness of from about 30 nm to about 250 nm, from about 80 nm to about 180 nm, or even from about 100 nm to about 160 nm.

In some aspects, the core of the encapsulate comprises a material selected from a perfume raw material and/or optionally a material selected from vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than about 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil or mixtures thereof; aromatic solvents, including benzene, toluene or mixtures thereof; silicone oils; or mixtures thereof.

In some aspects, the wall of the encapsulate comprises a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

In some aspects, suitable formaldehyde scavengers may be employed with the encapsulates, for example, in a capsule slurry and/or added to a composition before, during, or after the encapsulates are added to such composition.

Suitable capsules are disclosed in USPA 2008/0305982 A1; and/or USPA 2009/0247449 A1. Alternatively, suitable capsules can be purchased from Appleton Papers Inc. of Appleton, Wis. USA.

In addition, the materials for making the aforementioned encapsulates can be obtained from Solutia Inc. (St Louis, Mo. U.S.A.), Cytec Industries (West Paterson, N.J. U.S.A.), sigma-Aldrich (St. Louis, Mo. U.S.A.), CP Kelco Corp. of San Diego, Calif., USA; BASF AG of Ludwigshafen, Germany; Rhodia Corp. of Cranbury, N.J., USA; Hercules Corp. of Wilmington, Del., USA; Agrium Inc. of Calgary, Alberta, Canada, ISP of New Jersey U.S.A., Akzo Nobel of Chicago, Ill., USA; Stroever Shellac Bremen of Bremen, Germany; Dow Chemical Company of Midland, Mich., USA; Bayer AG of Leverkusen, Germany; Sigma-Aldrich Corp., St. Louis, Mo., USA.

Perfumes

Perfumes and perfumery ingredients may be used in the cleaning compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the cleaning composition.

Fillers and Carriers

Fillers and carriers may be used in the cleaning compositions described herein. As used herein, the terms "filler" and "carrier" have the same meaning and can be used interchangeably.

Liquid cleaning compositions and other forms of cleaning compositions that include a liquid component (such as liquid-containing unit dose cleaning compositions) may contain water and other solvents as fillers or carriers. Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used. Amine-containing solvents may also be used.

The cleaning compositions may contain from about 5% to about 90%, and in some examples, from about 10% to about 50%, by weight of the composition, of such carriers. For compact or super-compact heavy duty liquid or other forms of cleaning compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

For powder or bar cleaning compositions, or forms that include a solid or powder component (such as powder-containing unit dose cleaning composition), suitable fillers may include, but are not limited to, sodium sulfate, sodium chloride, clay, or other inert solid ingredients. Fillers may also include biomass or decolorized biomass. Fillers in granular, bar, or other solid cleaning compositions may comprise less than about 80% by weight of the cleaning composition, and in some examples, less than about 50% by weight of the cleaning composition. Compact or supercompact powder or solid cleaning compositions may comprise less than about 40% filler by weight of the cleaning composition, or less than about 20%, or less than about 10%.

For either compacted or supercompacted liquid or powder cleaning compositions, or other forms, the level of liquid or solid filler in the product may be reduced, such that either the same amount of active chemistry is delivered to the wash liquor as compared to noncompacted cleaning compositions, or in some examples, the cleaning composition is more efficient such that less active chemistry is delivered to the wash liquor as compared to noncompacted compositions. For example, the wash liquor may be formed by contacting the cleaning composition to water in such an amount so that the concentration of cleaning composition in the wash liquor is from above 0 g/l to 4 g/l. In some examples, the concentration may be from about 1 g/l to about 3.5 g/l, or to about 3.0 g/l, or to about 2.5 g/l, or to about 2.0 g/l, or to about 1.5 g/l, or from about 0 g/l to about 1.0 g/l, or from about 0 g/l to about 0.5 g/l. These dosages are not intended to be limiting, and other dosages may be used that will be apparent to those of ordinary skill in the art.

Buffer System

The cleaning compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, monoethanol amine or other amines, boric acid or borates, and other pH-adjusting compounds well known in the art.

The cleaning compositions herein may comprise dynamic in-wash pH profiles. Such cleaning compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Other Adjunct Ingredients

A wide variety of other ingredients may be used in the cleaning compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipds, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, diethylenetriaminepentaacetic acid, Tiron (1,2-diydroxybenzene-3,5-disulfonic acid), hydroxyethanedimethylenephosphonic acid, methylglycinediacetic acid, choline oxidase, pectate lyase, triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, an alkoxylated triphenylmethane polymeric colorant; an alkoxylated thiopene polymeric colorant; thiazolium dye, mica, titanium dioxide coated mica, bismuth oxychloride, paraffin waxes, sucrose esters, aesthetic dyes, hydroxamate chelants, and other actives.

The cleaning compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The cleaning compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The cleaning compositions of the present invention may also contain antimicrobial agents.

Preparation of Cleaning Compositions

The cleaning compositions of the present disclosure may be prepared by conventional methods known to one skilled in the art, such as by a batch process or by a continuous loop process. Non-limiting examples of processes suitable for preparing the present compositions are described in U.S. Pat. No. 4,990,280; U.S. 20030087791A1; U.S. 20030087790A1; U.S. 20050003983A1; U.S. 20040048764A1; U.S. Pat. No. 4,762,636; U.S. Pat. No. 6,291,412; U.S. 20050227891A1; EP 1070115A2; U.S. Pat. No. 5,879,584; U.S. Pat. No. 5,691,297; U.S. Pat. No. 5,574,005; U.S. Pat. No. 5,569,645; U.S. Pat. No. 5,565,422; U.S. Pat. No. 5,516,448; U.S. Pat. No. 5,489,392; and U.S. Pat. No. 5,486,303, all of which are incorporated herein by reference.

Methods of Use

The present invention includes methods for cleaning soiled material. As will be appreciated by one skilled in the art, the cleaning compositions of the present invention are suited for use in laundry pretreatment applications, laundry cleaning applications, and home care applications.

Such methods include, but are not limited to, the steps of contacting cleaning compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the cleaning compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry cleaning composition in accord with the invention. An "effective amount" of the cleaning composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 20:1. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The cleaning compositions herein may be used for laundering of fabrics at reduced wash temperatures. These methods of laundering fabric comprise the steps of delivering a laundry cleaning composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry cleaning composition with water.

Another method includes contacting a nonwoven substrate impregnated with an embodiment of the cleaning composition with soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Machine Dishwashing Methods

Methods for machine-dishwashing or hand dishwashing soiled dishes, tableware, silverware, or other kitchenware, are included. One method for machine dishwashing comprises treating soiled dishes, tableware, silverware, or other kitchenware with an aqueous liquid having dissolved or dispensed therein an effective amount of a machine dishwashing composition in accord with the invention. By an effective amount of the machine dishwashing composition it is meant from about 8 g to about 60 g of product dissolved or dispersed in a wash solution of volume from about 3 L to about 10 L.

One method for hand dishwashing comprises dissolution of the cleaning composition into a receptacle containing water, followed by contacting soiled dishes, tableware, silverware, or other kitchenware with the dishwashing liquor, then hand scrubbing, wiping, or rinsing the soiled dishes, tableware, silverware, or other kitchenware. Another method for hand dishwashing comprises direct application of the cleaning composition onto soiled dishes, tableware, silverware, or other kitchenware, then hand scrubbing, wiping, or rinsing the soiled dishes, tableware, silverware, or other kitchenware. In some examples, an effective amount of cleaning composition for hand dishwashing is from about 0.5 ml. to about 20 ml. diluted in water.

Packaging for the Compositions

The cleaning compositions described herein can be packaged in any suitable container including those constructed from paper, cardboard, plastic materials, and any suitable laminates. An optional packaging type is described in European Application No. 94921505.7.

Pouch Additive

The cleaning compositions described herein may also be packaged as a single compartment or a multi-compartment cleaning composition, for example in unitized dose form. For example, the cleaning compositions may be encapsulated in a water-soluble pouch. The water-soluble pouch may comprise polyvinyl alcohol (PVOH). The pouch may have contents in at least two compartments, or at least three compartments. The contents in each compartment may have the same color, or they may have different or contrasting colors. The contents in each compartment may be liquid, solid, or mixtures thereof. Suitable pouches and methods of forming such pouches are described, for example, in US Patent Applications 2002/0169092 and 2009/0199877, incorporated herein by reference.

EXAMPLES

In the examples, the following abbreviations are used:

| | |
|---|---|
| EO | ethylene oxide |
| PO | propylene oxide |
| PEI600 | polyethylenimine with an average molecular weight of 600 g/mol |
| x EO/NH | x mole ethylene oxide per mole of NH-functionality |
| y PO/NH | y mole propylene oxide per mole of NH-functionality |

Synthesis Examples

Example 1

PEI600+17 EO/NH+2 PO/NH+2 EO/NH a) PEI600+1 EO/NH

A 5 L autoclave is charged with 1943.0 g of a polyethylenimine with an average molecular weight of 600 g/mol and 97.0 g water. The reactor is purged three times with nitrogen and heated to 110° C. 1789.0 g ethylene oxide is added within 14 hours. To complete the reaction, the reaction mixture is allowed to post-react for 5 hours. Water and volatile compounds are removed in vacuo at 90° C. A highly viscous yellow oil (3688.0 g, water content: 2.6%, pH: 11.05 (5% in water)) is obtained.

b) PEI600+17 EO/NH+2 PO/NH+2 EO/NH

Product from example 1 a) (76.3 g) and 3.58 g potassium hydroxide (50% in water) is placed in a 2 L autoclave. The mixture is heated under vacuum (<10 mbar) to 120° C. and is stirred for 2 hours to remove water. The reactor is purged three times with nitrogen and the mixture is heated to 140° C. 637.6 g ethylene oxide are added within 7 hours, followed by addition of 104.4 g propylene oxide within 1.5 hours and afterwards 79.2 g ethylene oxide within 1.5 h. To complete the reaction, the mixture is allowed to post-react for 5 hours. Volatile compounds are removed in vacuo. 890.0 g of a slightly turbid liquid are obtained (melting point: 19.1° C.). Melting points were measured according to DIN 51007.

Example 2

PEI600+13 EO/NH+2 PO/NH+6 EO/NH

Product from example 1 a) (80.0 g) and 3.75 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 502.2 g ethylene oxide are added within 6 hours, followed by addition of 109.4 g propylene oxide within 1.5 hours and afterwards 249.0 g ethylene oxide within 3.5 h. To complete the reaction, the mixture is allowed to post-react for 5 hours. Volatile compounds are removed in vacuo. 938.0 g of a slightly turbid liquid are obtained (melting point: 6.8° C.).

Example 3

PEI600+11 EO/NH+2 PO/NH+8 EO/NH

Product similar to example 1 a) (80.2 g, 92.7% in water) and 3.58 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 399.9 g ethylene oxide are added within 5 hours, followed by addition of 104.4 g propylene oxide within 1.5 hours and afterwards 316.8 g ethylene oxide within 3.5 h. To complete the reaction, the mixture is allowed to post-react for 5 hours. Volatile compounds are removed in vacuo. 895.0 g of a slightly turbid liquid are obtained (melting point: 8.3° C., viscosity (20° C.) 2126 mPas, cloud point: 87° C. (Verfahren B)).

Example 4 a) PEI600+11 EO/NH+3 PO/NH+8 EO/NH

Product prepared as described in example 1 a) (76.3 g, 97.4% in water) and 3.8 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 400.0 g ethylene oxide are added within 6 hours, followed by addition of 156.6 g propylene oxide within 2 hours and afterwards 316.8 g ethylene oxide within 5 h. To complete the reaction, the mixture is allowed to post-react for 5 hours. Volatile compounds are removed in vacuo. 945.0 g of a light brown liquid are obtained (melting point: 3.8° C.)

b) PEI600+11 EO/NH+3 PO/NH+8 EO/NH, Quaternized with Dimethylsulfate

In a 500 ml reaction vessel with a nitrogen inlet, 160.0 g product from example 4 a) (PEI600+11 EO/NH+3 PO/NH+8 EO/NH) was heated to 70° C. under a constant stream of nitrogen. 17.40 g dimethyl sulfate was added dropwise at 70-75° C. and the reaction mixture was stirred for two hours at 70° C. under nitrogen. After cooling to room temperature, the pH was adjusted with 3.7 g sodium hydroxide (50% in water) to 9.2 (measured 10% in water). 185.0 g of a yellow liquid were obtained (amine value: 0.03 mgKOH/g, melting point: 5.0° C.). The degree of quaternization was 96%.

c) PEI600+11 EO/NH+3 PO/NH+8 EO/NH, Quaternized with Dimethylsulfate, Transsulfatized In a reaction vessel 70.0 g of product obtained in example 4 b) was heated under nitrogen atmosphere to 60° C. 2.0 g sulfuric acid (96%) was added at 60° C. to adjust the pH to 2.0 (measured 10% in water). The temperature was raised to 90° C. and the mixture was set under vacuum (15 mbar) for 3 hours. After cooling to 60° C. the pH was adjusted with 5.4 g sodium hydroxide (50% solution in water) to 9.3. 69.0 g of a brown liquid were obtained (melting point: 7.0° C., water: 0.5%)

Example 5

PEI600+9 EO/NH+2 PO/NH+10 EO/NH

Product from example 1 a) (76.3 g, 97.4% in water) and 3.58 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 320.7 g ethylene oxide are added within 4 hours, followed by addition of 104.4 g propylene oxide within 1.5 hours and afterwards 396.0 g ethylene oxide within 6 h. To complete the reaction, the mixture is allowed to post-react for 5 hours. Volatile compounds are removed in vacuo. 895.0 g of a slightly brown liquid are obtained (melting point: 7.7° C.).

Example 6

PEI600+5 EO/NH+2 PO/NH+14 EO/NH

Product from example 1 a) (76.3 g, 97.4% in water) and 3.6 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 162.4 g ethylene oxide are added within 2 hours, followed by addition of 104.4 g propylene oxide within 1.5 hours and afterwards 554.4 g ethylene oxide within 8 h. To complete the reaction, the mixture is allowed to post-react for 5 hours. Volatile compounds are removed in vacuo. 896.0 g of a slightly turbid liquid are obtained (melting point: 17.7° C.).

Comparative Example 1 (CE 1)

PEI600+20 EO/NH (B3651

Product prepared as described in example 1 a) (144.6 g, 92.7% in water) and 4.34 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 1470.7 g ethylene oxide are added within 14 hours. To complete the reaction, the mixture is allowed to post-react for 5 hours. Volatile compounds are removed in vacuo. 1615.0 g of a slightly brown solid are obtained (melting point: 35.4° C.).

Comparative Example 2 (CE 2)

PEI600+19 EO/NH+2 PO/NH

Product prepared as described in example 1 a) (80.2 g, 92.7% in water) and 3.58 g potassium hydroxide (50% in water) was placed in a 21 autoclave. The mixture was heated under vacuum (<10 mbar) to 120° C. and stirred for 2 hours to remove water. The reactor was purged three times with nitrogen and the mixture was heated to 140° C. 716.8 g ethylene oxide were added within 8 hours, followed by addition of 104.4 g propylene oxide within 1 hour. To complete the reaction, the mixture was allowed to post-react for 5 hours. Volatile compounds were removed in vacuo. 897.0 g of a slightly brown solid were obtained (melting point: 28.7° C.).

Comparative Example 3 (CE 3)

PEI600+2,5 EO/NH+2 PO/NH+16.5 EO/NH

Product similar to example 1 a) (80.2 g, 92.7% in water) and 3.58 g potassium hydroxide (50% in water) was placed in a 21 autoclave. The mixture was heated under vacuum (<10 mbar) to 120° C. and stirred for 2 hours to remove water. The reactor was purged three times with nitrogen and the mixture was heated to 140° C. 63.4 g ethylene oxide were added within 1 hour, followed by addition of 104.4 g propylene oxide within 1 hour and followed by addition of 653.4 g ethylene oxide within 6 hours. To complete the reaction, the mixture was allowed to post-react for 5 hours. Volatile compounds were removed in vacuo. 896.0 g of a slightly brown solid were obtained (melting point: 27.2° C.).

Comparative Example 4 (CE 4)

PEI600+2 PO/NH+19 EO/NH a) PEI600+1 PO/NH

A 2 L autoclave is charged with 430.0 g of a polyethylenimine with an average molecular weight of 600 g/mol and 21.5 g water. The reactor is purged three times with nitrogen and heated to 110° C. 522.0 g propylene oxide are added within 10 hours. To complete the reaction, the reaction mixture is allowed to post-react for 5 hours. Water and volatile compounds are removed in vacuo at 90° C. A highly viscous yellow oil (970.0 g, water content: 2.6%) is obtained.

b) PEI600+2 PO/NH+19 EO/NH

Product from example 5 a) (76.2 g, 97.4% in water) and 3.18 g potassium hydroxide (50% in water) is placed in a 2 L autoclave. The mixture is heated under vacuum (<10 mbar) to 120° C. and stirred for 2 hours to remove water. The reactor is purged three times with nitrogen and the mixture is heated to 140° C. 51.04 g propylene oxide are added within 10 minutes, followed by addition of 668.8 g ethylene oxide within 10 hours. To complete the reaction, the mixture is allowed to post-react for 5 hours. Volatile compounds are removed in vacuo. 793.0 g of a light brown solid are obtained (melting point: 35.8° C.).

Melting Points

Melting points of selected alkoxylated polyalkylenamines according to the present invention are compared with comparative examples (CE); see Table 1. Melting points are determined according to DIN 51007 with a differential scanning calorimeter 823/700/229 from Mettler Toledo.

TABLE 1

Melting points

| Example N° | Polymer type | melting point per DSC (peak temperature) (° C.) |
|---|---|---|
| CE1 | PEI600 + 20 EO/NH | 34 |
| CE2 | PEI600 + 19 EO/NH + 2 PO/NH | 28.7 |
| 1 | PEI600 + 17 EO/NH + 2 PO/NH + 2 EO/NH | 19.1 |
| 2 | PEI600 + 13 EO/NH + 2 PO/NH + 6 EO/NH | 6.8 |
| 3 | PEI600 + 11 EO/NH + 2 PO/NH + 8 EO/NH | 8.3 |
| 4a) | PEI600 + 11 EO/NH + 3 PO/NH + 8 EO/NH | 3.8 |
| 4b) | PEI600 + 11 EO/NH + 3 PO/NH + 8 EO/NH, quaternized with dimethylsulfate | 5.0 |
| 4c) | PEI600 + 11 EO/NH + 3 PO/NH + 8 EO/NH, quaternized with dimethylsulfate, transsulfatized | 7.0 |
| 5 | PEI600 + 9 EO/NH + 2 PO/NH + 10 EO/NH | 7.7 |
| 6 | PEI600 + 5 EO/NH + 2 PO/NH + 14 EO/NH | 17.7 |
| CE3 | PEI600 + 2.5 EO/NH + 2 PO/NH + 16.5 EO/NH | 27.2 |
| CE4 | PEI600 + 2 PO/NH + 19 EO/NH | 35.8 |

Melting points are determined according to DIN 51007 with a differential scanning calorimeter 823/700/229 from Mettler Toledo Sample Cleaning Compositions The following cleaning compositions may be prepared according to conventional methods.

TABLE 2 liquid laundry detergent

| | Liquid Detergent (wt %) |
|---|---|
| AES $C_{12-15}$ alkyl ethoxy (1.8) sulfate | 10.9 |
| Alkyl benzene sulfonate [2] | 1.56 |
| Sodium formate | 2.66 |
| Sodium hydroxide | 0.21 |
| Monoethanolamine (MEA) | 1.65 |
| Diethylene glycol (DEG) | 4.10 |
| AE9[3] | 0.40 |
| C16AE7 | 3.15 |
| Alkoxylated Polyethyleneimine[1] | 1.04 |
| Chelant[4] | 0.18 |
| Citric Acid | 1.70 |
| $C_{12-18}$ Fatty Acid | 1.47 |
| Borax | 1.19 |
| Ethanol | 1.44 |
| A compound having the following general structure: bis($(C_2H_5O)(C_2H_4O)n)(CH3)—N^+—C_xH_{2x}—N^+—(CH_3)$-bis($(C_2H_5O)(C_2H_4O)n$), wherein n = from 20 to 30, and x = from 3 to 8, or sulphated or sulphonated variants thereof | 0.40 |
| 1,2-Propanediol | 2.40 |
| Protease (54.5 mg active/g)[9] | 0.89 |
| Mannanase: Mannaway ® (25.6 mg active/g)[5] | 0.04 |
| Amylase: Natalase ® (29 mg active/g) | 0.14 |
| Fluorescent Whitening Agents[10] | 0.10 |
| Water, perfume, dyes & other components | Balance |

[1]Polymer according to Example 2, described above

[2] Linear alkylbenzenesulfonate having an average aliphatic carbon chain length $C_{11}$-$C_{12}$ supplied by Stepan, Northfield, Illinois, USA

[3]AE9 is $C_{12-13}$ alcohol ethoxylate, with an average degree of ethoxylation of 9, supplied by Huntsman, Salt Lake City, Utah, USA

[4]Suitable chelants are, for example, diethylenetetraamine pentaacetic acid (DTPA) supplied by Dow Chemical, Midland, Michigan, USA or Hydroxyethane di phosphonate (HEDP) supplied by Solutia, St Louis, Missouri, USA Bagsvaerd, Denmark

[5]Natalase ®, Mannaway ® are all products of Novozymes, Bagsvaerd, Denmark.

6. Proteases may be supplied by Genencor International, Palo Alto, California, USA (e.g. Purafect Prime ®) or by Novozymes, Bagsvaerd, Denmark (e.g. Liquanase ®, Coronase ®).

[10]Suitable Fluorescent Whitening Agents are for example, Tinopal ® AMS, Tinopal ® CBS-X, Sulphonated zinc phthalocyanine Ciba Specialty Chemicals, Basel, Switzerland 11. Polymer according to Example 2, described above

TABLE 3

Laundry Cleaning Powder Composition

| | Powder Detergent (wt %) |
|---|---|
| Linear alkylbenzenesulfonate[1] | 8.2 |
| AE3S[2] | 1.9 |
| Zeolite A[3] | 1.8 |
| Citric Acid | 1.5 |
| Sodium Carbonate[5] | 29.7 |
| Silicate 1.6R ($SiO_2$:$Na_2O$)[4] | 3.4 |
| Soil release agent[6] | 0.2 |
| Acrylic Acid/Maleic Acid Copolymer[7] | 2.2 |
| Carboxymethylcellulose | 0.9 |
| Protease - Purafect ® (84 mg active/g)[9] | 0.08 |
| Amylase - Stainzyme Plus ® (20 mg active/g)[8] | 0.16 |
| Lipase - Lipex ® (18.00 mg active/g)[8] | 0.24 |
| Cellulase - Celluclean ™ (15.6 mg active/g)[8] | 0.1 |
| Alkoxylated Polyethyleneimine[10] | 1.0 |
| TAED [11] | 3.26 |
| Percarbonate[12] | 14.1 |
| Na salt of Ethylenediamine-N,N'-disuccinic acid, (S,S) isomer (EDDS)[13] | 2.19 |

TABLE 3-continued

| Laundry Cleaning Powder Composition | |
|---|---|
| | Powder Detergent (wt %) |
| Hydroxyethane di phosphonate (HEDP)[14] | 0.54 |
| $MgSO_4$ | 0.38 |
| Perfume | 0.38 |
| Suds suppressor agglomerate[15] | 0.04 |
| Sulphonated zinc phthalocyanine (active)[16] | 0.0012 |
| Sulfate/Water & Miscellaneous | Balance |

[1]Linear alkylbenzenesulfonate having an average aliphatic carbon chain length $C_{11}$-$C_{12}$ supplied by Stepan, Northfield, Illinois, USA

[2]AE3S is $C_{12-15}$ alkyl ethoxy (3) sulfate supplied by Stepan, Northfield, Illinois, USA

[3]Zeolite A is supplied by Industrial Zeolite (UK) Ltd, Grays, Essex, UK

[4]1.6R Silicate is supplied by Koma, Nestemica, Czech Republic

[5]Sodium Carbonate is supplied by Solvay, Houston, Texas, USA

[6]Soil release agent is Repel-o-tex ® PF, supplied by Rhodia, Paris, France

[7]Acrylic Acid/Maleic Acid Copolymer is molecular weight 70,000 and acrylate:maleate ratio 70:30, supplied by BASF, Ludwigshafen, Germany

[8]Savinase ®, Natalase ®, Stainzyme ®, Lipex ®, Celluclean ™, Mannaway ® and Whitezyme ® are all products of Novozymes, Bagsvaerd, Denmark.

[9]Proteases may be supplied by Genencor International, Palo Alto, California, USA (e.g. Purafect Prime ®) or by Novozymes, Bagsvaerd, Denmark (e.g. Liquanase ®, Coronase ®).

[10]Polymer according to Example 1, described above

[11] TAED is tetraacetylethylenediamine, supplied under the Peractive ® brand name by Clariant GmbH, Sulzbach, Germany

[12]Sodium percarbonate supplied by Solvay, Houston, Texas, USA

[13]Na salt of Ethylenediamine-N,N'-disuccinic acid, (S,S) isomer (EDDS) is supplied by Octel, Ellesmere Port, UK

[14]Hydroxyethane di phosphonate (HEDP) is supplied by Dow Chemical, Midland, Michigan, USA

[15]Suds suppressor agglomerate is supplied by Dow Corning, Midland, Michigan, USA

[16]Fluorescent Brightener 1 is Tinopal ® AMS, Fluorescent Brightener 2 is Tinopal ® CBS-X, Sulphonated zinc phthalocyanine and Direct Violet 9 is Pergasol ® Violet BN-Z all supplied by Ciba Specialty Chemicals, Basel, Switzerland

TABLE 4

| WE laundry liquid composition | |
|---|---|
| | WE Liquid HDL (wt %) |
| AE3S[4] | 2.6 |
| Alkyl benzene sulfonate [3] | 7.5 |
| Sodium formate/Calcium formate | 0.4 |
| Sodium hydroxide | 3.7 |
| Monoethanolamine (MEA) | 0.3 |
| Diethylene glycol (DEG) | 0.8 |
| AE9[6] | 0.4 |
| AE7[5] | 4.4 |
| Alkoxylated Polyethyleneimine[1] | 1.0 |
| Chelant[7] | 0.3 |
| Citric Acid | 3.2 |
| $C_{12-18}$ Fatty Acid | 3.1 |
| Ethanol | 2.0 |
| Amphiphilic polymer [2] | 0.5 |
| A compound having the following general structure: $bis((C_2H_5O)(C_2H_4O)n)(CH_3)—N^+—C_xH_{2x}—N^+—(CH_3)$-$bis((C_2H_5O)(C_2H_4O)n)$, wherein n = from 20 to 30, and x = from 3 to 8, or sulphated or sulphonated variants thereof | 1.0 |
| 1,2-Propanediol | 3.9 |
| Protease (40.6 mg active/g)[9] | 0.6 |

TABLE 4-continued

| WE laundry liquid composition | |
|---|---|
| | WE Liquid HDL (wt %) |
| Amylase: Stainzyme ® (15 mg active/g)[8] | 0.2 |
| Fluorescent Whitening Agents[10] | 0.1 |
| Water, perfume, dyes & other components | Balance |

[1]Polymer according to Example 5, described above

[2] Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[3] Linear alkylbenzenesulfonate having an average aliphatic carbon chain length $C_{11}$-$C_{12}$ supplied by Stepan, Northfield, Illinois, USA

[4]AE3S is $C_{12-15}$ alkyl ethoxy (3) sulfate supplied by Stepan, Northfield, Illinois, USA

[5]AE7 is $C_{12-15}$alcohol ethoxylate, with an average degree of ethoxylation of 7, supplied by Huntsman, Salt Lake City, Utah, USA

[6]AE9 is $C_{12-13}$ alcohol ethoxylate, with an average degree of ethoxylation of 9, supplied by Huntsman, Salt Lake City, Utah, USA

[7]Suitable chelants are, for example, diethylenetetraamine pentaacetic acid (DTPA) supplied by Dow Chemical, Midland, Michigan, USA or Hydroxyethane di phosphonate (HEDP) supplied by Solutia, St Louis, Missouri, USA Bagsvaerd, Denmark

[8]Savinase ®, Natalase ®, Stainzyme ®, Lipex ®, Celluclean ™, Mannaway ® and Whitezyme ® are all products of Novozymes, Bagsvaerd, Denmark.

[9]Proteases may be supplied by Genencor International, Palo Alto, California, USA (e.g. Purafect Prime ®) or by Novozymes, Bagsvaerd, Denmark (e.g. Liquanase ®, Coronase ®).

[10]Suitable Fluorescent Whitening Agents are for example, Tinopal ® AMS, Tinopal ® CBS-X, Sulphonated zinc phthalocyanine Ciba Specialty Chemicals, Basel, Switzerland

TABLE 5

| Liquid Laundry Composition | |
|---|---|
| | Liquid Detergent (wt %) |
| AES $C_{12-15}$ alkyl ethoxy (1.8) sulfate | 10.9 |
| Alkyl benzene sulfonate [2] | 1.56 |
| Sodium formate | 2.66 |
| Sodium hydroxide | 0.21 |
| Monoethanolamine (MEA) | 1.65 |
| Diethylene glycol (DEG) | 4.10 |
| AE9[3] | 0.40 |
| C16AE7 | 3.15 |
| Alkoxylated Polyethyleneimine[1] | 2.5 |
| Chelant[4] | 0.18 |
| Citric Acid | 1.70 |
| $C_{12-18}$ Fatty Acid | 1.47 |
| Borax | 1.19 |
| Ethanol | 1.44 |
| A compound having the following general structure: $bis((C_2H_5O)(C_2H_4O)n)(CH_3)—N^+—C_xH_{2x}—N^+—(CH_3)$-$bis((C_2H_5O)(C_2H_4O)n)$, wherein n = from 20 to 30, and x = from 3 to 8, or sulphated or sulphonated variants thereof | 0.40 |
| 1,2-Propanediol | 2.40 |
| Protease (54.5 mg active/g)[9] | 0.89 |
| Mannanase: Mannaway ® (25.6 mg active/g)[5] | 0.04 |
| Amylase: Natalase ® (29 mg active/g)[5] | 0.14 |
| Fluorescent Whitening Agents[10] | 0.10 |
| Water, perfume, dyes & other components | Balance |

[1]Polymer according to Example 6, described above

[2] Linear alkylbenzenesulfonate having an average aliphatic carbon chain length $C_{11}$-$C_{12}$ supplied by Stepan, Northfield, Illinois, USA

[3]AE9 is $C_{12-13}$ alcohol ethoxylate, with an average degree of ethoxylation of 9, supplied by Huntsman, Salt Lake City, Utah, USA

[4]Suitable chelants are, for example, diethylenetetraamine pentaacetic acid (DTPA) supplied by Dow Chemical, Midland, Michigan, USA or Hydroxyethane di phosphonate (HEDP) supplied by Solutia, St Louis, Missouri, USA Bagsvaerd, Denmark

[5]Natalase ®, Mannaway ® are all products of Novozymes, Bagsvaerd, Denmark.

6. Proteases may be supplied by Genencor International, Palo Alto, California, USA (e.g. Purafect Prime ®) or by Novozymes, Bagsvaerd, Denmark (e.g. Liquanase ®, Coronase ®).

[10]Suitable Fluorescent Whitening Agents are for example, Tinopal ® AMS, Tinopal ® CBS-X, Sulphonated zinc phthalocyanine Ciba Specialty Chemicals, Basel, Switzerland The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition comprising:

from about 1% to about 70% by weight of a surfactant system, wherein the surfactant system comprises a detersive surfactant selected from the group consisting of anionic surfactants, nonionic surfactants, cationic surfactants, zwitterionic surfactants, amphoteric surfactants, ampholytic surfactants, and mixtures thereof; and from about 0.1% to about 5% by weight of the composition, of an alkoxylated polyalkylenimine of the general formula I

I

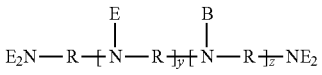

in which the variables are each defined as follows:

R represents identical or different, linear or branched $C_2$-$C_{12}$-alkylene radicals or an etheralkyl unit of formula X:

X

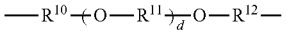

in which the variables are each defined as follows:

$R^{10}$, $R^{11}$, $R^{12}$ represent identical or different, linear or branched $C_2$-$C_6$-alkylene radicals and d is an integer having a value in the range of from about 0 to about 50;

B represents a continuation of the alkoxylated polyalkylenimine by branching;

y is from about 0 to about 150, z is greater than 0 and less than or equal to about 150;

E is an alkylenoxy unit of the formula II

II in which the variables are each defined as follows:

$R^1$ represents 1,2-propylene;

$R^2$ represents hydrogen and/or $C_1$-$C_{22}$-alkyl and/or $C_7$-$C_{22}$ aralkyl;

each of m and p independently has a value in the range of from about 5 to about 14;

n is an integer having a value in the range of from about 1 to about 5; and m+p is equal to or greater than about 14.

2. The composition according to claim 1, wherein the sum of y+z is at least about 1.

3. The composition according to claim 1, wherein R is ethylene or hexamethylene.

4. The composition according to claim 1, wherein the alkoxylated polyalkyleneamine comprises a polyalkylenamine that, before alkoxylation, has a weight average molecular weight (Mw) of from about 250 to about 10 000 g/mol.

5. The composition according to claim 1, wherein up to about 100% of the nitrogen atoms present in the polyalkylenimine are quaternized.

6. The composition according to claim 5, wherein the degree of quaternization of the nitrogen atoms present in the polyalkylenimine is in the range of from about 10% to about 95%.

7. The composition according to claim 5, wherein the quaternized polyalkylenimine is sulfatized or transsulfatized.

8. The composition according to claim 1, further comprising from about 0.001% to about 1% by weight of enzyme.

9. The composition of claim 6, wherein said enzyme is selected from lipase, amylase, protease, mannanase, or combinations thereof.

10. The composition of claim 1, further comprising from about 0.1% to about 10% by weight of an additional amine.

11. The composition of claim 10 wherein said additional amine is selected from oligoamines, triamines, diamines, or a combination thereof.

12. The composition of claim 10 wherein said additional amine is selected from tetraethylenepentamine, triethylenetetraamine, diethylenetriamine, or a mixture thereof.

13. The composition of claim 1 further comprising a hueing agent.

14. A method of pretreating or treating a soiled fabric comprising contacting the soiled fabric with the composition of claim 1.

15. A cleaning composition comprising:

from about 1% to about 70% by weight of a surfactant system, wherein the surfactant system comprises a detersive surfactant selected from the group consisting of anionic surfactants, nonionic surfactants, cationic surfactants, zwitterionic surfactants, amphoteric surfactants, ampholytic surfactants, and mixtures thereof; and from about 0.1% to about 5% by weight of a water-soluble alkoxylated polyalkylenimine of Formula IV, Formula IV

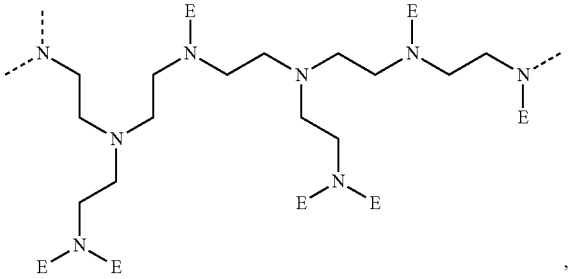

wherein E is an alkylenoxy unit of formula II $$-(CH_2CH_2O)_m(R^1-O)_n(CH_2CH_2O)_p-R^2 \quad \text{II}$$

in which the variables are each defined as follows:

$R^1$ represents 1,2-propylene;

$R^2$ represents hydrogen and/or $C_1$-$C_4$-alkyl;

each of m and p independently has a value in the range of from about 5 to about 14 n is an integer having a value in the range of from about 1 to about 5; and m+p is equal to or greater than about 14.

16. The composition of claim 1, wherein said composition comprises from about 5% to about 50%, by weight of the composition, water.

17. The composition of claim 15, wherein said composition comprises from about 5% to about 50%, by weight of the composition, water.

18. The composition of claim 1, wherein the surfactant system comprises anionic surfactant.

19. The composition of claim 1, wherein $R^2$ is hydrogen.

20. The composition of claim 1, wherein R represents $C_2$-alkylene radicals.

* * * * *